United States Patent [19]

Aultz et al.

[11] 3,942,435

[45] Mar. 9, 1976

[54] DEPOSITORY FOR RECEIVING, IMPRINTING AND STORING DEPOSITED ARTICLES OF VARIABLE THICKNESS

[75] Inventors: Thomas R. Aultz; Jerome L. Kistner, both of Cincinnati, Ohio

[73] Assignee: The Mosler Safe Company, Hamilton, Ohio

[22] Filed: Jan. 6, 1975

[21] Appl. No.: 539,021

[52] U.S. Cl. ..... 101/44; 346/22; 109/25; 101/316

[51] Int. Cl.[2] ..... B41F 17/00

[58] Field of Search ..... 101/4, 35, 41–44, 101/306, 316, 317, 379–380; 109/25, 45, 46, 48, 59, 66; 346/22; 232/47, 57, 43.3, 28, 44

[56] References Cited

UNITED STATES PATENTS

| | | | |
|---|---|---|---|
| 1,259,399 | 3/1918 | Hipnell et al. | 346/22 X |
| 2,030,313 | 2/1936 | Murtaugh | 109/46 |
| 3,094,920 | 6/1963 | Priesmeyer | 101/41 |
| 3,272,119 | 9/1966 | Keramas | 101/44 |
| 3,465,955 | 9/1969 | De Baer et al. | 232/43.3 X |
| 3,784,090 | 1/1974 | Markham | 232/47 X |
| 3,836,980 | 9/1974 | Grosswiller et al. | 232/44 X |
| 3,866,235 | 2/1975 | Maynard et al. | 109/66 X |

*Primary Examiner*—Edgar S. Burr
*Assistant Examiner*—Edward M. Coven
*Attorney, Agent, or Firm*—Wood, Herron & Evans

[57] ABSTRACT

A depository for receiving, imprinting and storing deposited articles of varying thickness including a housing having a slot in the front thereof through which articles of variable thickness are inserted, a vault also located within the housing into which articles inserted through the housing slot are ultimately transferred for storage, and a movable tube for temporarily storing an article inserted therein through the housing slot while the same is imprinted with a date of deposit or the like and thereafter transferring the imprinted article to the vault. The tube is movable between a first, article-receiving position in which an article receiving end communicates with the housing slot to permit an inserted article to be received within the tube; a second, article-discharge position in which the article stored in the tube is discharged under the force of gravity into the vault via an opening in the other end of the tube; and third, article-imprinting positions variably located intermediate the first and second positions in which the articles of varying thickness in the tube are imprinted by a printer mounted on the tube, which printer moves into imprinting relationship with the temporarily stored article as an incident to movement of the tube between the first, article-receiving position and the second, article-discharge position. The slot in the housing is dimensioned such that it is smaller than the tube in which the inserted articles are temporarily stored to effect imprinting, to prevent insertion into the tube of an article which, with respect to the tube, is oversized and which could lodge in the tube and fail to be discharged into the vault under the force of gravity when the tube is placed in its article-discharge position.

10 Claims, 8 Drawing Figures

DEPOSITORY FOR RECEIVING, IMPRINTING AND STORING DEPOSITED ARTICLES OF VARIABLE THICKNESS

This invention relates to depositories for imprinting and storing articles inserted therein, and more particularly to depositories of the foregoing type which are capable of imprinting deposited articles of varying thickness.

Depositories for storing articles, such as envelopes containing cash, negotiable instruments and the like, have for many years been widely used in the banking field to facilitate deposits by bank customers during nonbanking hours, e.g., when the bank is closed. These depositories, often known as "night depositories", are typically provided with means for imprinting the deposited article with various kinds of information useful to the bank, including the date of deposit, the bank branch where the depository is located, and a serial number unique to each deposited article. The serial number, if a receipt is provided to the depositor, will also be imprinted on the receipt along with the date and bank branch location.

To achieve consistent and uniformly legible imprints on deposited articles it is essential that the face of the printhead squarely strike the imprint-receiving surface of the deposited article, and further that it strike the deposited article with a force sufficient to achieve the desired imprint yet not so large as to damage the printing mechanism and/or produce a blurred imprint. These problems of achieving consistently uniform engagement of the printhead with respect to both squareness of the print face and striking force is readily solved where the articles to be imprinted do not vary in thickness. Specifically, in a case of deposit articles of uniform thickness, the location of the imprint-receiving surface of the deposited article, once within the depository, is relatively fixed in space. As a consequence, the travel of the printhead, including its orientation at the movement of imprint and its limit of movement in the imprinting direction, can be selected for any given thickness and the printer adjusted to achieve the desired squareness and imprinting force for deposited items of that thickness. Once the travel of the printhead has been adjusted for articles of a predetermined thickness, and assuming the thickness of the articles does not change and the machine remains in adjustment, consistently uniform imprints on deposited articles can be expected.

Apparatus of the foregoing type is unsatisfactory when the depository must imprint articles which vary in thickness to any significant extent. For example, when an article is inserted having a thickness greater than that for which the imprinter is adjusted, the printhead will strike the article permaturely. Premature striking of the article may, if the printhead travels through an arcuate path, result in the print face thereof striking the imprint-receiving surface of the article skeined or oblique fashion, i.e., producing an illegible imprint. In addition, since the printhead strikes the thicker article permaturely, the resulting imprinting force may be larger than desired, causing damage to the equipment and/or illegible, blurred imprints. On the other hand, if an article has a thickness less than that for which the imprinter is adjusted, the printhead may reach its limit of travel without ever striking the imprint-receiving surface of the inserted item, resulting in no imprint.

Should the imprinter be designed to provide some overtravel, the printhead thereof may strike the thinner article, but if the path of travel of the printheadd is arcuate, it may strike the article obliquely, resulting in an imperfect imprint.

It has been an objective of this invention to provide a depository of the imprinting type which is capable of providing uniformly consistent imprints on articles of varying thickness without need for interim readjustments as the article thickness varies. This objective has been accomplished in accordance with certain principles of this invention by providing, in a depository having a slotted housing into which articles are inserted, a vault into which articles are transferred for storage following imprinting, and a movable transfer tube for transferring the inserted articles to the vault, the novel and unobvious combination of (a) an imprinter having a printhead aligned with an opening in the side wall of the transfer tube, (b) guide means mounted on the tube for moving the imprinter along a path between an outer position in which the tube interior is unobstructed and varying inner positions depending upon the thickness of the inserted article temporarily stored in the tube, and (c) yieldable means mounted on a stationary support within the housing for driving the imprinter through the tube opening toward the inserted article in response to movement of the tube between an article-receiving position and an article-discharge position, which yieldable means terminates imprinter movement relative to the tube as a consequence of continued movement of the tube following imprinting.

In a preferred embodiment of the invention, the imprinter guide includes a parallel linkage assembly which interconnects the imprinter and tube to guide the printhead for movement along a slightly curved path through the tube opening toward the inserted article temporarily stored in the tube and the yieldable means includes a link pivotally mounted on a stationary support within the housing which releasably engages the parallel linkage assembly to drive the printhead into the tube as the tube moves and upon the imprinter striking the article to automatically release upon further movement of the tube, thereby terminating advancement of the printhead at varying points depending upon the thickness of the imprinted article.

The imprinter, in the preferred form of the invention, is mounted to what constitutes the underside of the tube when the latter is in its article-imprinting position, which position is intermediate the location of the tube in its article-receiving and article-discharge positions. With the printer so located, when the parallel linkage is released from engagement with the stationarily-mounted yieldable link as an incident to movement of the tube following imprinting, the imprinter is free to move under the force of gravity to a lower position which, with respect to the tube, returns the printhead to its outboard position. This leaves the interior of the tube unobstructed and imprinted items free to fall under the force of gravity into the vault when the tube reaches the discharge position upon continued movement thereof subsequent to imprinting.

In accordance with a further feature of the invention an improved interlock mechanism is provided for locking a cover provided for the housing slot when the tube, in which is stored an inserted item, is moved from the article-receiving position to effect imprinting and thereafter further moved to discharge the imprinted article into the vault. The improved interlock includes a slideable detent which is advanced by a cam on the tube when the latter moves from the article-receiving position aligned with the slot. The advancement is in a direction to engage the detent with a cooperating recess provided on a rearwardly projecting extension of the slot cover, thereby locking the cover to prevent movement from its closed position, sealing the slot. When the tube has returned to its article-receiving position in alignment with the article insertion slot in the housing, the detent, which is spring-biased toward its retracted position, returns to its retracted position, disengaging the cooperating recess associated with the cover, and thereby unlocking the door.

In accordance with a still further feature of the invention, the article insertion slot in the housing is dimensioned such that it is smaller in both width and length than that of the transfer tube in which inserted articles are temporarily stored during imprinting. By so dimensioning the housing slot relative to the transfer tube, the largest article insertable through the slot will be smaller than the maximum size article which the tube can accommodate, thereby insuring that articles received in the transfer tube will, when the tube moves to its discharge position, be free to slide under the force of gravity from the tube into the vault.

These and other advantages and objectives of the invention will become more readily apparent from a detailed description of a preferred embodiment thereof taken in conjunction with the drawings in which.

Figure 1:
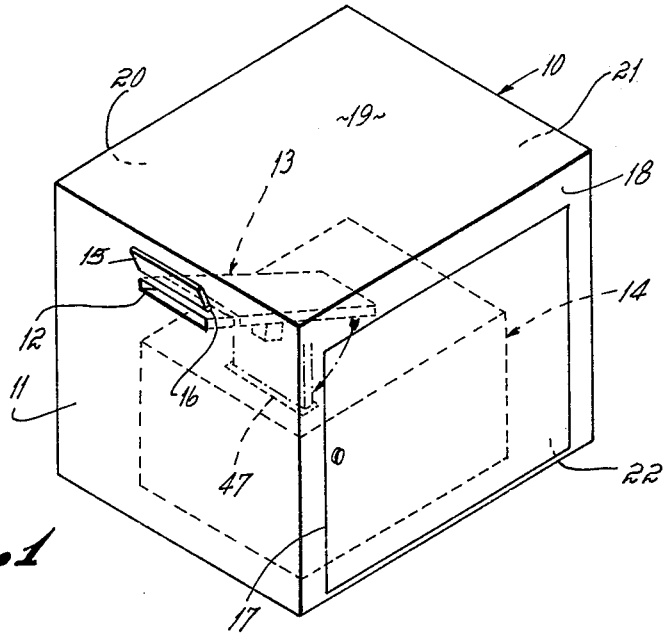
FIG. 1 is a perspective view of the depository of this invention showing, in schematic form, the article insertion slot in the housing, the vault into which imprinted articles are ultimately stored, and the transfer and imprinting mechanism which imprints and transfers to the vault articles inserted into the housing slot.

With reference to the drawings, particularly FIG. 1, the preferred embodiment of the depository of this invention is seen to include a housing 10, which takes the general form of a box or cabinet for enclosing the various depository operating components. The housing 10 includes a front face or wall 11 provided with a slot 12 into which a customer of a bank or the like, whereat the depository is located, can insert a generally flat deposit article, such as an envelope containing money, negotiable instruments, etc. Once inserted into the slot 12, the deposit article is imprinted and thereafter transferred by means of an article imprinting and transfer mechanism 13 to be described, to a vault 14 located within the housing in the lower section thereof.

Slot 12 is provided with a cover 15 hinged along its upper horizontal edge 16 to the front wall 11 of the housing 10 above the upper edge of the slot. The cover 15, in a manner also to be described, is selectively lockable. The housing 10 also includes a side door 17 provided in a housing side wall 18 to facilitate access to the vault 14 by bank personnel, such at the end of each day, for removal of the contents of the vault. Completing the housing 10 is a top 19, a side wall 20, a rear wall 21, and a bottom 22. The housing 10, in addition to enclosing the depository structure of this invention, could also enclose other equipment appropriate to a banking installation such as cash dispensing apparatus and the like.

Figure 2:
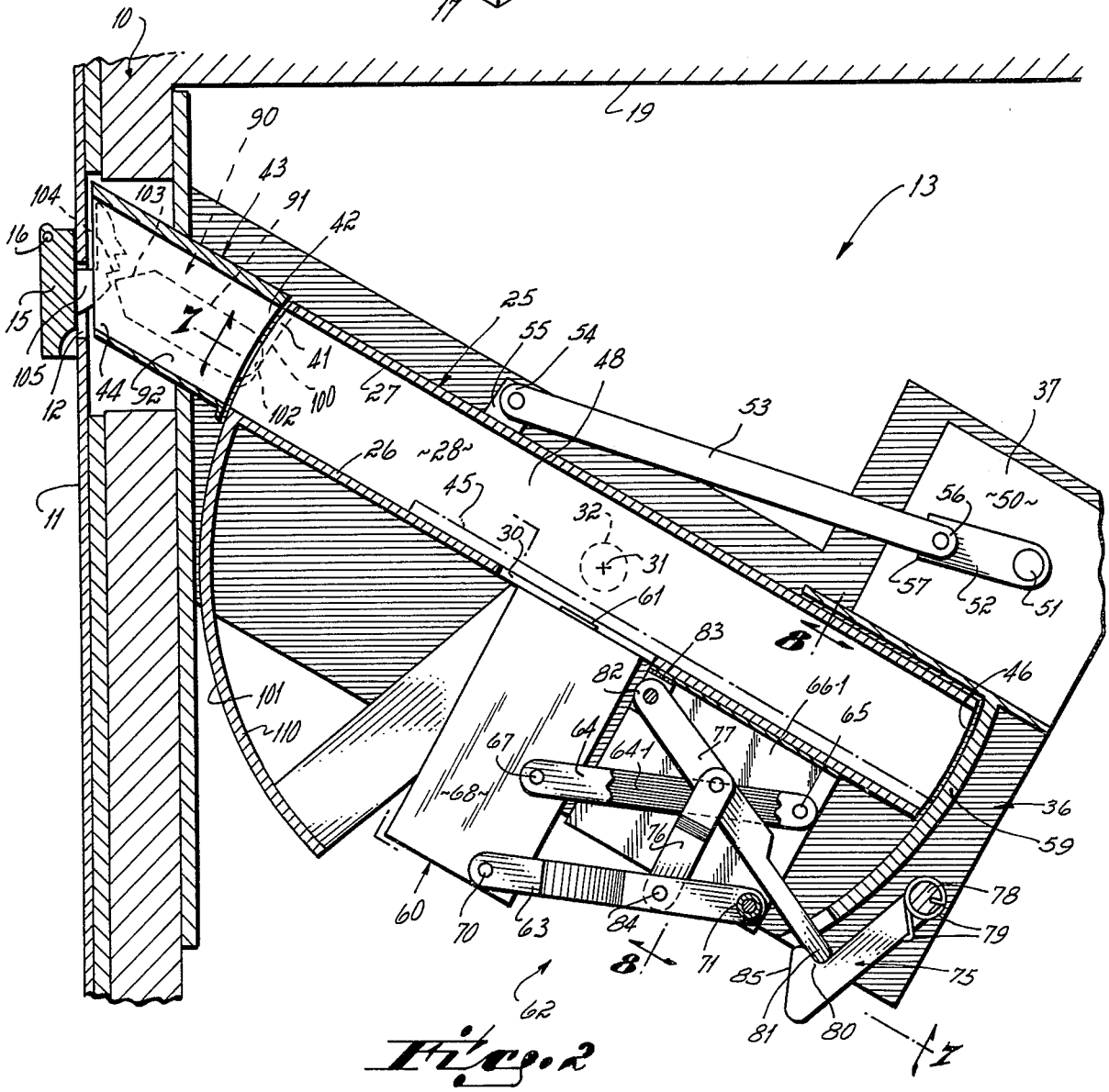
FIG. 2 is a side elevational view, partially in cross-section, of thhe imprinting and transfer mechanism in the article-receiving position.
Figure 3:
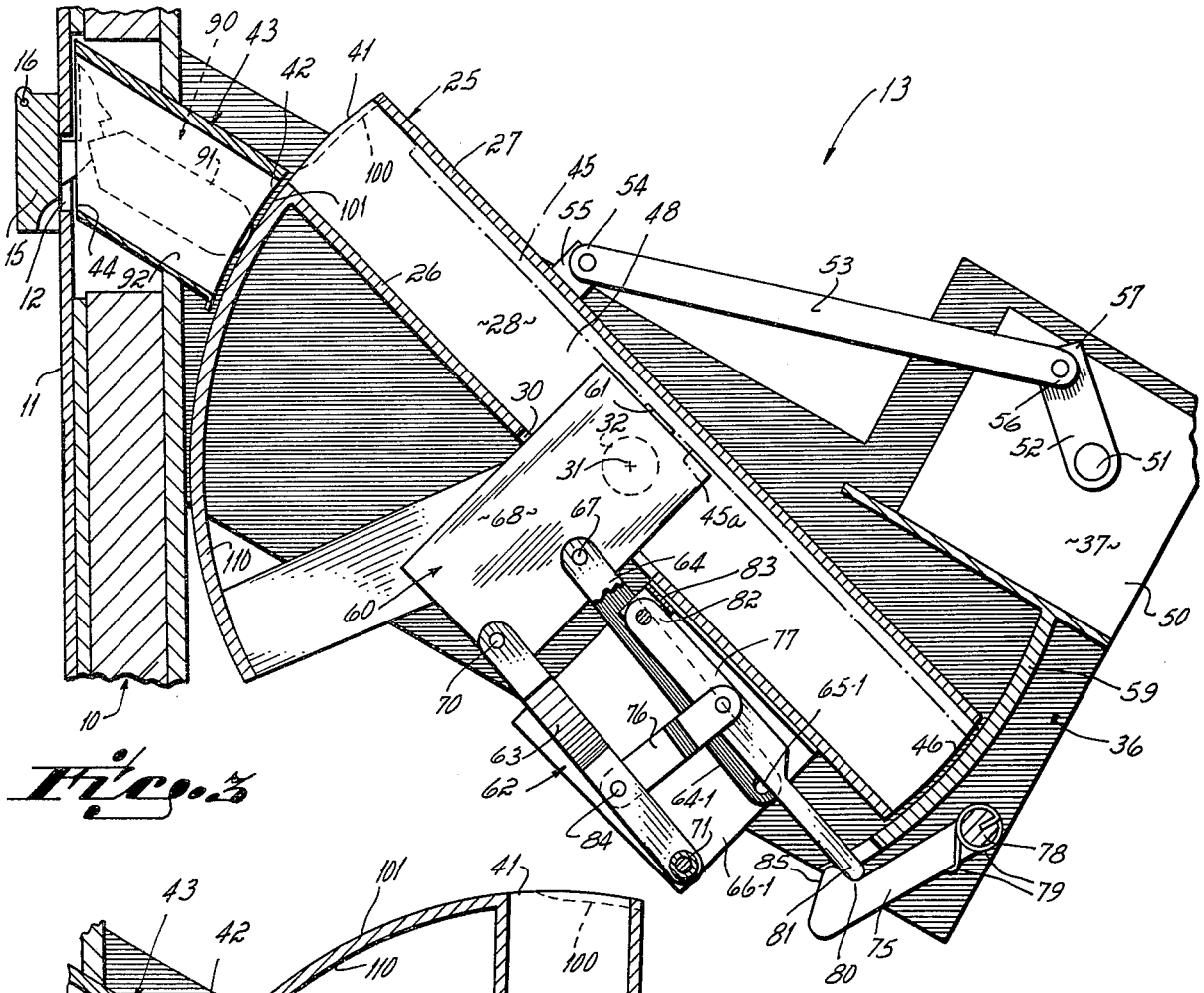
FIG. 3 is a side elevational view, partially in cross-section, showing the imprinting and transfer mechanism in one of its article-imprinting positions.
Figure 4:
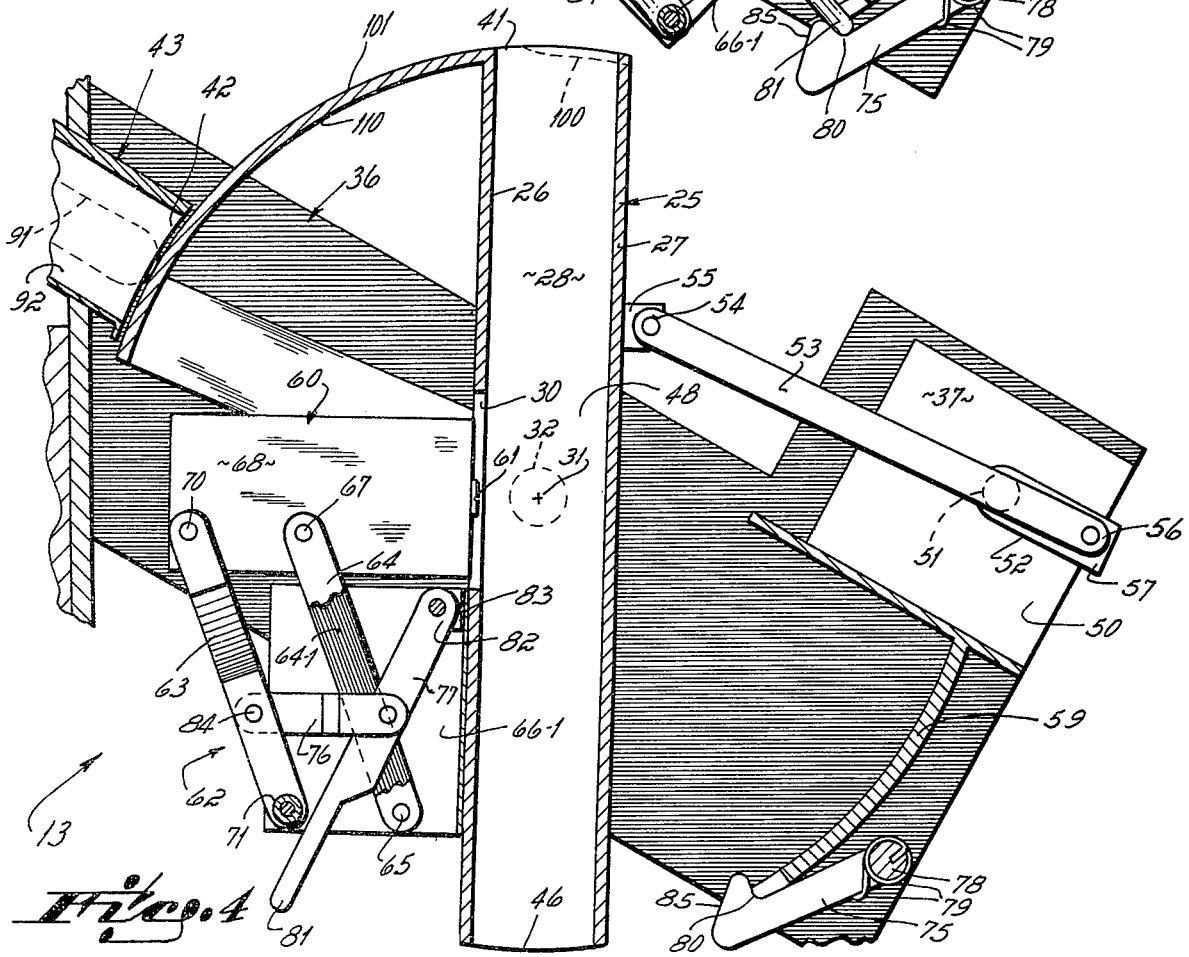
FIG. 4 is a side elevational view, partially in cross-section, showing the imprinting and transfer mechanism in the article-discharge position.

The imprinting and transfer mechanism 13, considered in more detail in connection with FIGS. 2, 3, 4, and 8 includes an elongated hollow tube 25 having a generally rectangular cross-section defined by a bottom wall 26, a top wall 27 and opposite side walls 28 and 29. Bottom wall 26 is provided with an opening 30 therein intermediate its ends for reasons to be apparent hereafter. The tube 25 is mounted for pivotal movement about a horizontal axis 31 by mounts 32 and 33 which pivotally interconnect tube side walls 28 and 29 with spaced points 34 and 35 of a stationary supporting frame 36 located within the housing 10. A drive mechanism 37 interconnecting the stationary frame 36 and the upper wall 27 of the tube 25 is provided to pivot the tube clockwise through a predetermined path from an article-receiving position (FIG. 2) to an article-discharging position (FIG. 4). In the course of moving from the article-receiving position (FIG. 2) to the article-discharging position (FIG. 4), the tube 25 moves through variable article-imprinting positions (FIG. 3), only one of which is shown for convenience. The variable article-imprinting positions, which are intermediate the article-receiving and article-discharging positions, each corresponding to a slighly different position of the tube occupied when articles of respectively different thickness are imprinted, in a manner to be described.

In the article-receiving positon of the tube 25 depicted in FIG. 2 an open, article-receiving end 41 of the tube is aligned with the lower end 42 of a stationarily mounted chute 43, the upper end 44 of which is aligned with the article insertion slot 12 formed in the housing front wall 11. When in the article-receiving position shown in FIG. 2, tube 25 is designed to receive a deposited article, such as envelope 45 inserted through the tube opening 41 via chute 43 and slot 12. When in the article-discharge position (FIG. 4), the discharge end 46 of the tube 25 is aligned over vault slot 47 to facilitate gravity discharge of an imprinted article 45 from chamber 48 for storage in the vault 14.

The cross-section of chute 43 is generally coextensive with that of tube 25. The cross-section of slot 12 is, however, purposely dimensioned to be less than that of tube 25 to prevent insertion of an oversized article in the tube chamber 48 which, when the tube is in its discharge position (FIG. 4), might jam and fail to discharge from the tube into the vault 14 under the force of gravity. Stated differently, since the cross-sectional area of the slot 12, with respect to both width and length, is less than that of the tube 25, an article insertable through the slot 12 will, providing it does not expand, easily fit within the tube chamber 48 and discharge under the force of gravity into the vault 14 when the tube is moved to its discharge position shown in FIG. 4.

The drive mechanism 37 includes a motor, rotary solenoid or the like 50 stationarily mounted on the frame 36, which has an output shaft 51 rotatable about a horizontal axis. Fixedly secured and extending radially from the drive shaft 51 is a drive arm 52. A drive link 53 is pivotally interconnected at one end 54 to a bracket 55 projecting outwardly from the tube wall 27 and at the other end 56 to the outer end 57 of the drive arm 52. Rotation of the arm 52 in a clockwise direction about the drive shaft 51 in response to energization of the device motor or rotary solenoid 50 pivots the tube 25 in a clockwise direction about pivot mounts 32 and 33 to move the tube from its article-receiving position shown in FIG. 2, through variable article-imprinting positions shown in FIG. 3, to the article-discharge position shown in FIG. 4.

A stationary shield 59 in the form of a slightly curved panel is secured to the frame 36 slightly spaced from the discharge end 46 of the tube 25 when the tube is in its article-receiving position (FIG. 2) and its article-imprinting positions (FIG. 3). Stationary shield 59 prevents an article 45 temporarily stored in the tube chamber 48 from gravity induced discharge therefrom via tube end 46 before the tube had pivoted past the imprinting position (FIG. 3) in the course of moving from the article-receiving position (FIG. 2) to the article-discharge position (FIG. 4). Shield 59 also inhibits access to the underlying vault 14 via the tube 25 when the tube is in the article-receiving position (FIG. 2) with its article-input end 41 aligned with the end 42 of the stationary tube 43.

As noted, rotation of drive arm 52 in a clockwise direction from the position shown in FIG. 2 to the position shown in FIG. 3 is operative to effect imprinting of an article 45 temporarily stored in the tube chamber 48, and when further rotated in a clockwise direction is effective to rotate the tube to the position shown in FIG. 4 for gravity discharge of the imprinted article into the vault 14 via the opening 47 in the top thereof. Once arm 52 has been rotated to the position shown in FIG. 4, the tube 25 can be returned to the article-receiving position of FIG. 2 by either further clockwise motion of the arm 52 or by counterclockwise motion thereof. In the article-discharge position of the tube (FIG. 4), arm 52 is aligned with and overlaps the drive link 53 and rotation of the arm 52 in either a clockwise or a counterclockwise direction is operative to return the tube 25 to its article-receiving position (FIG. 2) from the article-discharge position (FIG. 4).

The imprinting and transfer mechanism 13 also includes an imprinter 60 having a printhead 61 at one end thereof. The imprinter 60 may be any of the commercially available varieties such as that manufactured by Practical Automation, Inc., Sheldon, CT model CM10P/Z/S which is suitably electrically controlled to render the printhead 61 effective to print desired information on the article 45 temporarily stored in the chamber 48 when the printhead 61 strikes the article, in a manner to be described. The imprinter 60 has its printhead 61 aligned with the opening 30 in wall 26 of tube 25 and is mounted for movement in a predetermined path relative to the tube 25 via a linkage 62 between an outer position (FIG. 2) and varying inner positions (FIG. 3) in which the printhead extends through the opening 30 into the chamber 48 differing amounts to accomodate imprinting articles of respectively different thickness temporarily stored in the chamber 48.

The linkage 62, in a preferred form, includes an S-shaped link 63 and a straight link 64 which are not disposed in a single plane, but which although not actually parallel and equal in length, effectively constitute a parallel linkage mechanism due to the fact that the axes about which the opposite ends of each of the links pivot define four vertices of a parallelogram in all operative orientations. Link 64 which is straight, is pivotally connected at one end 65 to a bracket 66 projecting from the outer surface of the tube bottom wall 26 and at its other end 67 is privotally connected to the side 68 of imprinter 60. Link 63, which is S-shaped, is pivotally connected at one end 70 to the side 68 of imprinter 60 and at its other end to a pin 71 fixed to the bracket 66, the pin 71 having a shoulder to space the arm from the bracket 66 proximate the longitudinal center of the tube 25. Linkage 62 also includes links 63-1 and 64-1 which, like links 63 and 64 are S-shaped and straight so that they are not disposed in a single plane, but are not parallel and equal in length, yet function as a parellel linkage mechanism due to the fact that the axes about which the opposite ends of each pivot, define four vertices of a parallelogram in all operative orientations. Link 64-1 is straight and pivotally interconnected at its end 67-1 to the side 68-1 of the imprinter 60 and at its other end 65-1 is pivotally interconnected to the bracket 66-1. Link 63-1, which is S-shaped, is pivotally connected at one end 70-1 to the side 68-1 of the imprinter 60 and at its other end to a pin 71-1 fixed to the bracket 66-1, the pin 71-1 having a shoulder to space the arm from the bracket proximate the longitudinal center of the tube 25 and thus proximate the other S-shaped arm 63.

By virtue of the two parallel linkage mechanism 63, 64 and 63-1, 64-1, connected in the manner described, the imprinter 60 is movable, relative to the tube 25, in only a straight line path which, in a preferred embodiment, is perpendicular to the tube wall 27 and hence to the side surface **45*a* of an article 45 temporarily stored in the tube 25 upon which the imprint with the printhead 61 is made when the imprinter is advanced to the imprint positions depicted in FIG. 3. In this way, the printhead 61 squarely strikes the surface 45*a* of an article 45 in chamber 48 regardless of its thickness, and hence regardless of the displacement of its surface 45*a* from the tube wall 27**.

To advance the imprinter 60, and hence the printhead 61, through the tube opening 30 to strike the article surface **45*a* to form an imprint on an article 45 temporarily stored in the tube chamber 48 when the tube 25 rotates from the article-receiving position (FIG. 2) to the article-imprinting position (FIG. 3), a yieldable element 75 is provided which interconnects, via auxiliary links 76 and 77, the stationary frame 36 and the linkage 62. The yieldable element 75, which preferably is in the form of an elongated link is pivotally connected at its end 78 to the stationary frame 36 and biased in a clockwise direction by a sprint 79. The yieldable element 75 at its free end is provided with a detent or shoulder 80. Shoulder 80 normally engages the free end 81 of auxiliary link 77 which at its other end is pivotally mounted by a pin 82 fixed between brackets 83. Auxiliary link 76 is pivotally connected at one end to an intermediate portion of link 77 and at its other end to a pin 84 fixed between links 63 and 63-1.**

In operation, and assuming that tube 25 is in the article-receiving position shown in FIG. 2 with the detent 80 of spring-biased arm 75 engaged with end 81 of link 77, when the tube 25 is rotated clockwise about its axis 31 by drive mechanism 37, link end 81 is restrained against motion relative to stationary frame 36. With end 81 of link 77 restrained against motion, the link 77, which is pivotally connected at its other end to pin 82 spanning brackets 83 which are mounted for movement with tube 25, pivots counterclockwise about pin 82 relative to the tube 25. Counterclockwise pivotal motion of link 77 about pin 82 pivots, via link 76, parallel links 63, 64 and 73-1, 64-1 clockwise relative to the tube 25 about their ends 65, 71 and 65-1, 71-1. Clockwise pivotal motion of parallel links 63 and 64, in the manner indicated is effective to advance the imprinter 60, and hence the printhead 61, through the opening 30 of tube wall 26 into the chamber 48 of tube 25 toward tube wall 27 and hence toward the surface 45*a* of article 45 temporarily stood in the chamber 48.

Continued pivotal motion of tube 25 about axis 31 under the action of drive mechanism 37 continues to advance the imprinter 60 through the opening 30 toward tube wall 27 and hence toward imprint-receiving surface 45*a* of article 45, until such time as the printhead 61 strikes the surface 45*a* of article 45 located against tube wall 27 at which time the imprint is made. When the printhead 61 has struck the article to imprint surface 45 thereof, the imprinter 60 is no longer able to advance further through the tube opening 30 toward the tube wall 27. Thus, relative movement of the parallel links 63, 64 and auxiliary links 76 and 77 with respect to the tube 25, which tube continues to rotate under the action of drive mechanismm 37, must terminate. With pivotal motion of line 77 about its pivot 82 relative to tube 25 no longer possible due to abutment of printhead 61 against article 45 which is itself in contact with tube wall 27, continued clockwise rotation of the tube 25 from the article-imprinting position shown in FIG. 3, causes the link end 81 to disengage shoulder 80.

As should be apparent, depending on the thickness of the article 45 in chamber 48, the imprint-receiving surface 45*a* will be spaced from tube wall 27 differing distances, the distance increasing and decreasing as the thickness of the article increases and decreases, respectively. In turn, the spacing of the printhead 61 from tube wall 27 at the instant of striking artice surface 45*a* to form an imprint depends on the thickness of the article, the distance being greater and lesser as the thickness increases and decreses, respectively. Since rotation tube 25 produces the movement of the printhead 61 relative to the tube 25, the pivotal position about axis 31 of tube 25 at the instant of imprint, i.e., at the instant printhead 61 strikes article surface 45*a*, varies as the thickness of the imprinted article varies, the tube positon at the instant of imprint being further clockwise as the thickness decreases and vice versa. Correspondingly, the shoulder 80 and link end 81, which disengage at an incident to imprinting an article with printhead 61, will occur earlier or later in the pivotal cycle of tube 25 depending upon the thickness of the article imprinted, disengagement being earlier as the thickness increases and vice versa. Significantly, the depository of this invention accommodates different thickness articles, producing uniformity interfacing of the printhead and article surface in terms of imprint force and squareness, to assure consistent imprint quality, and does so automatically and without need for interim adjustments as the thickness of the article varies.

Disengagement of shoulder 80 of spring-biased link 75 from end 81 of auxiliary link 77 which, as noted, occurs as a result of continued clockwise motion of the tube 25 after the printhead 61 has abutted an article 45 located against the tube wall 27, permits the parallel links 63, 64 and 63-1, 64-1 to pivot counterclockwise about their ends 65, 71 with respect to tube 25. With links 63, 64 free to pivot clockwise about their pivotally connected ends 65, 71 the imprinter 60 will, under the force of gravity, move downwardly and withdraw the printhead 61 from the printing position (FIG. 3) to the article-discharging position (FIG. 4). With the printhead 61 withdrawn from the chamber 48, the imprinted article 45 is free to discharge from chamber 48 into vault 14 via tube end 46 and vault slot 47 uninhibited by any mechanical interference with printhead 61.

The imprint force, which is independent of the thickness of the article being imprinted, is a function of the resistance to release of arm end 81 which shoulder 80 presents during movement of the tube 25. Thus, the greater (or lesser) the force applied by shoulder 80 to arm end 81, the greater (or lesser) the imprint force. However, for any given release force, the imprint force will be constant regardless of the thickness of the article being imprinted.

Once the tube 25 reaches the position shown in FIG. 4 and the imprinted article is discharged therefrom into the vault 14, the drive mechanism 37 returns the tube 25 to the article-receiving position shown in FIG. 2 in the course of which end 81 of auxiliary link 75, camming the link 75 counterclockwise about pivot 78 to again engage link end 81 with shoulder 80 as shown in FIG. 2. The tube is now in the article-receiving position and an article receipt in the tube, imprinting thereof, and discharge of the imprinted article to the vault 14, can be repeated in accordance with the steps described.

Figure 5:
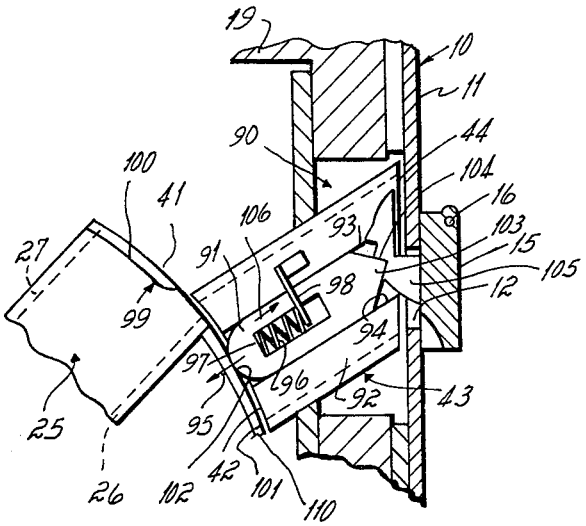
FIG. 5 is a side elevational view, partially in cross-section, of the slot cover interlock mechanism, with the tube in nonalignment with the housing slot, showing the detent thereof cammed to its outer position to lock the door in the closed position.

As previously noted, the article insertion slot 12 formed in the front wall 11 of the housing 10 is provided with a cover 15 which is hinged along cover edge 16 to the housing front wall for movement between an open position (FIG. 6) and a closed position sealing slot 12 (FIG. 5). To prevent opening of the cover 15 after an article has been inserted via slot 12 into the tube 25 and prior to its imprinting and ultimate discharge into the vault 14, a cam-operated lock mechanism 90 is provided.

The lock mechanism 90 includes an elongated lock member or bar 91 which is mounted for bi-directional sliding movement by guide shoulders 93 and 94 formed on one side wall 92 of the chute 43. The lock bar 91 is normally biased in the direction of arrow 95 by compression spring 96 located between a shoulder 97 of the lock bar 91 and a stop 98 secured to chute side wall 92. A movable cam 99 having an inner cam surface 100 and an outer cam surface 101 is provided which, in one cam position wherein inner cam surface 100 abuts lock bar end 102, shifts the lock bar 91 to its inner or retracted position (FIG. 6) and in another cam position in which cam surface 101 abuts lock bar end 102, shifts the lock bar 91 to its outer position (FIG. 5).

Figure 6:
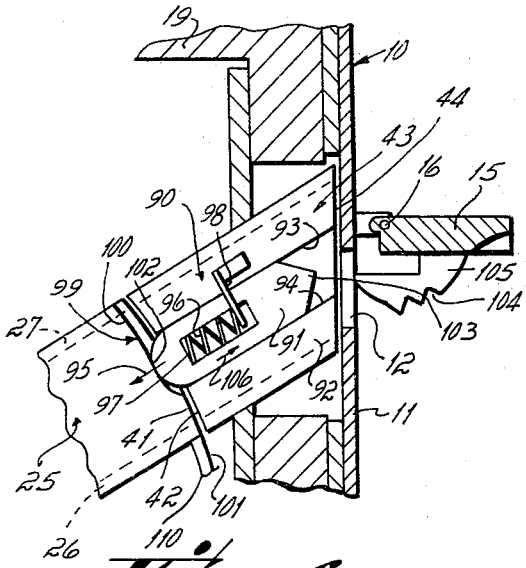
FIG. 6 is a side elevational view, partially in cross-section, of the cover interlock mechanism, with the tube in the article-receiving position aligned with the slot showing, and the detent in its retracted position unlocking the slot cover.
Figure 7:
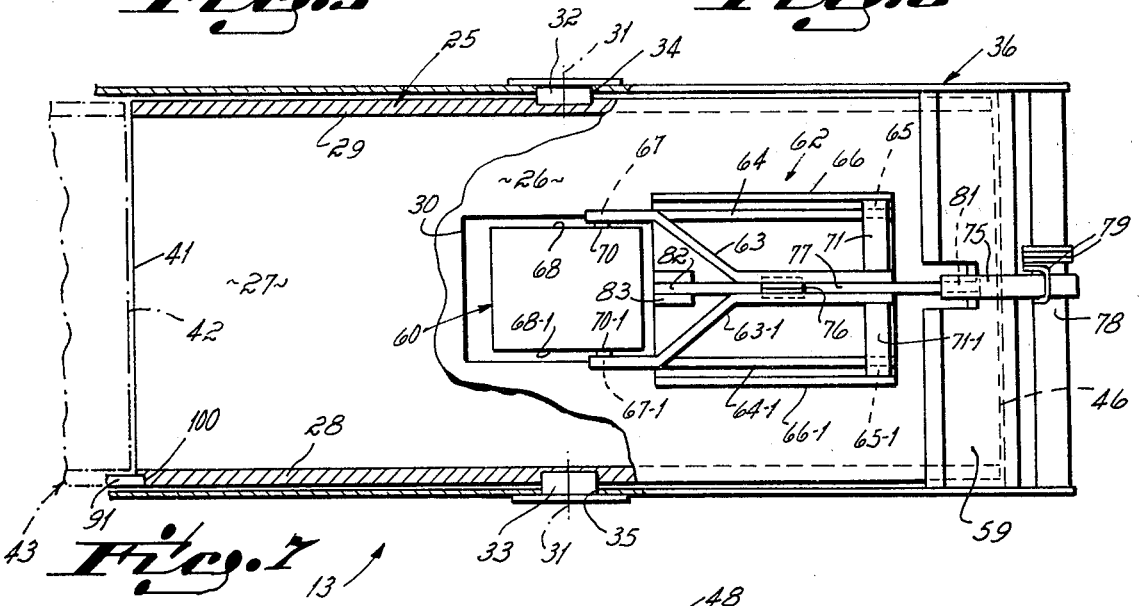
FIG. 7 is a cross-sectional view taken along line 7—7 of FIG. 2.
Figure 8:
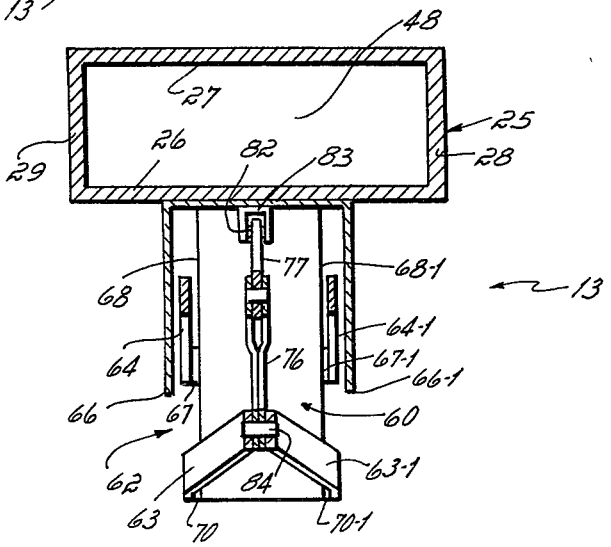
FIG. 8 is a cross-sectional view taken along line 8—8 of FIG. 2.

In the retracted position of lock bar 91, wherein lock bar end 102 engages inner cam surface 100, the outer detent end 103 of the lock bar 91 is disengaged from a recess 104 formed in a structural bracket 105 extending rearwardly from the cover 15, permitting the cover 15 to be opened. Thus, when the tube 25 is in the article-receiving position depicted in FIG. 2, the inner cam surface 100 is seated behind lock bar end 102, permitting the lock bar 91 to be retracted and the detent 103 to be disengaged from the recess 104 formed on the cover extension 105, in turn permitting the cover to move from the closed position to the open position (FIG. 6). However, when the tube 25 rotates from the article-receiving position (FIG. 2) toward the imprinting position (FIG. 3) and the discharge position (FIG. 4), outer cam surface 101 moves into engagement with lock bar end 102, urging the lock bar 91 in an outer direction parallel to arrow 106, advancing the detent 103 into engagement with the recess 104 formed in the extension 105 secured to the back of cover 15 (FIG. 5). With the lock bar detent 103 engaged with recess 104, pivotal motion of the cover 15 about hinge 16 is prevented and cover 15 cannot be opened, prohibiting access to the interior of the housing 10 via slot 12. Of course, when the tube 25 returns to the article-receiving position (FIG. 3) inner cam surface 100 once again underlies the end 102 of lock bar 91 allowing it to retract under the bias of spring 96 to disengage detent 103 from recess 104, again permitting the cover 15 to pivot about hinge 16 and provide access to the slot 12 for insertion of an article into the tube chamber 48 (FIG. 6).

A slightly curved shield 110 extending downwardly from the article insertion end 41 of the tube 25, in addition to constituting the outer cam surface 101 which urges the lock bar 91 to its outer lock position, also functions to block the lower end 42 of chute 43 when the tube 25 moves from the article-receiving position (FIG. 2) to the article-imprinting position (FIG. 3) and the article-discharge position (FIG. 4).

As those skilled in the art will appreciate, it is desirable to include control circuit means (not shown) for sensing the presence in the tube chamber 48 of a deposited article 45, and in response thereto energizing the motor 50 to effect rotation of the tube from its article-receiving position (FIG. 2) to the imprinting position (FIG. 3) and thereafter to the article-discharge position (FIG. 4). A suitable sensor could include a light source and phototransducer positioned within the tube 25 at locations such that an inserted article 45 interrupts the beam of light from the source to the phototransducer. The article detection arrangement could also be utilized to control motor 50 for returning the tube 25 to its article-receiving position (FIG. 2) when the article has been discharged into the vault 14 following imprinting. Suitable controls of the kind indicated are conventional and accordingly are not further detailed herein.

Pursuant to the requirements of the patent statutes, the principle of this invention has been explained and exemplified in a manner so that it can be readily practiced by those skilled in the art to which it pertains, or with which it is most nearly connected, such exemplification including what is presently considered to represent the best embodiment of the invention. However, it should be clearly understood that the above description and illustrations are not intended to unduly limit the scope of the appended claims, but that therefrom the invention may be practiced otherwise than as specifically described and exemplified herein, by those skilled in the art, and having the benefit of this disclosure.

What is claimed as being patentably novel is:

1. A depository for receiving and imprinting generally flat articles of varying thickness inserted therein, comprising:

a housing having an article-insertion slot provided in one wall thereof, a hollow tube within said housing having an interior defining a chamber for temporarily storing an article to be imprinted, said tube having an article-receiving opening and an article-discharge opening disposed at opposite ends thereof in communication with said chamber, said tube having an additional opening intermediate its opposite ends, a mount connected to said tube for mounting said tube for movement through a predetermined path between (a) an article-receiving position, in which said article-receiving opening of said tube communicates with said article-insertion slot of said housing to facilitate insertion of an article into said chamber via said housing slot and article-receiving opening, and (b) an article-discharge position in which said slot and article-receiving opening are non-communicative and said article-discharge opening is disposed lower than said article-receiving opening to facilitate gravity discharge through said article-discharge opening of an article temporarily stored in said tube, said predetermined tube movement path including movement through variable article-imprinting positions whereat different thickness articles are imprinted, an article imprinter having a printhead aligned with said additional opening in said tube intermediate the opposite ends thereof, a linkage interconnecting said imprinter and said tube for facilitating movement of said imprinter along a predetermined path between (a) variable inner positions in which said printhead extends through said additional opening varying distances into said chamber to imprint articles of different thickness temporarily stored in said tube, and (b) an outer position in which said printhead is substantially withdrawn from said chamber, drive means connected to said tube to move said tube from said article-receiving position through said variable article-imprinting positions to said article-discharge position, a stationary suport within said housing, and a yieldable means connecting said stationary support and said linkage, said yieldable means being operative prior to yielding to advance said imprinter from its outer position to one of said variable inner positions associated with a predetermined article thickness whereat said printhead imprints an article having said predetermined thickness temporarily stored in said chamber as said drive means moves said tube from said article-receiving position to said one article-imprinting position, said yieldable means being operative to yield as an incident to said imprinting to prevent further advancement of said imprinter relative to said imprinted article while said tube continues to move toward said article-discharge position past said one article-imprinting position.

2. The depository of claim 1 wherein said article-receiving opening in said tube is dimensioned relative to said article-insertion slot in said housing to accommodate thicker articles for storage in said tube chamber than can be inserted therein via said insertion slot, thereby preventing insertion of an oversized article in said tube chamber which would fail to discharge under the force of gravity when said tube is positioned in said article-discharge position.

3. The depository of claim 1 further including a stationary shield within said housing mounted proximate said discharge opening of said tube to block said discharge opening except when said tube is in said article-discharge position.

4. The depository of claim 1 further including a cover mounted to said housing for movement between an open position in which said slot in said housing is accessible and a closed position blocking access to said slot, a cover lock member movable between a lock position in which said cover is locked in said closed position by said lock member and an unlock position in which said cover is unlockd, and a cam mounted for movement incident to movement of said tube, said cam being movable between (a) a first position in which said lock member is cammed into said unlock position when said article-receiving opening of said tube communicates with said article-insertion slot of said housing and (b) a second position in which said lock member is cammed by said cam to its lock position when said tube is moving toward its article-discharge position.

5. The depository of claim 4 further including a detent mounted on one of said cover and lock member and a recess in the other of said cover and lock member, and wherein said cam is mounted for movement with said tube to cam said lock member and engage said recess and detent to lock said cover closed when said tube moves away from said article-receiving position.

6. The depository of claim 1 wherein said yieldable means is releasably connected to one of said stationary support and said linkage and operative, prior to release, to effect said imprinter advance toward said article stored in said chamber and operative, upon imprinting, to release and prevent further advancement of said printhead into said chamber.

7. The depository of claim 6 wherein said imprinter is mounted below said tube to move downwardly under the force of gravity upon release of said yieldable means to at least partially withdraw said printhead from said chamber and thereby enhance gravity-induced discharge of an imprinted article from said tube when said tube moves toward said discharge position following imprinting.

8. The depository of claim 6 wherein said linkage includes a parallel linkage assembly interconnecting said imprinter and said tube to promote uniform interfacing of said printhead and an article stored in said tube for different thickness articles.

9. The depository of claim 8 wherein said yieldable means includes a link pivotally connected at one point to said stationary support and releasably connected at another point to said linkage for pivoting said parallel linkage assembly to advance said imprinter as said tube moves toward its discharge position, said link releasing said parallel linkage assembly upon imprinting an article in said tube chamber to terminate imprinter advance as said tube moves further toward said discharge position.

10. A depository for receiving and imprinting generally flat articles of varying thickness inserted therein, comprising:

a housing having an article-insertion slot provided in one wall thereof, a hollow tube within said housing having an interior defining a chamber for temporarily storing an article to be imprinted, said tube having an article-receiving opening and an article-discharge opening disposed at opposite ends thereof in communication with said chamber, said tube having an additional opening intermediate its opposite ends, a mount connected to said tube for mounting said tube for movement through a predetermined path between (a) an article-receiving position, in which said article-receiving opening of said tube communicates with said article-insertion slot of said housing to facilitate insertion of an article into said tube chamber via said housing slot and tube article-receiving opening, and (b) an article-discarge position in which said slot and article-receiving opening are non-communicative and said aritcle-discharge opening is disposed lower than said article-receiving opening to facilitate gravity discharge through said discharge opening of an article temporarily stored in said tube, an article imprinter having a printhead aligned with said additional opening in said tube intermediate the opposite ends thereof, means mounted on said tube for guiding said imprinter for relative bidirectional motion along a path which includes (a) an outer position wherein said printhead is substantially withdrawn from said tube and (b) variable inner positions in which said printhead extends into said chamber differing amounts to imprint differing thickness articles stored in said tube chamber, drive means connected to said tube to move said tube from said article-receiving position to said article-discharge position, a stationary support within said housing, means for relatively moving said imprinter toward an article in said tube chamber when said tube moves toward said discharge position under the action of said drive means, and means for terminating said relative movement of said imprinter toward said article before said tube reaches said discharge position.

* * * * *